US005505550A

United States Patent [19]

Kitahara et al.

[11] Patent Number: 5,505,550

[45] Date of Patent: Apr. 9, 1996

[54] PRINTER AND METHOD OF SUPPLYING CONTINUOUS PAPER TO PRINTING PORTION

[75] Inventors: Satoshi Kitahara, Mishima; Hiroyasu Ishii, Numazu; Kazuhiro Fushimi, Mishima, all of Japan

[73] Assignee: Kabushiki Kaisha TEC, Shizuoka, Japan

[21] Appl. No.: 407,918

[22] Filed: Mar. 21, 1995

[30] Foreign Application Priority Data

Mar. 23, 1994 [JP] Japan ..... 6-052279

[51] Int. Cl.[6] ..... B41J 11/46

[52] U.S. Cl. ..... 400/618; 400/636; 400/191; 226/4; 226/29; 226/36; 226/45; 101/228

[58] Field of Search ..... 400/611, 613, 400/613.1, 617, 618, 619, 636, 191; 226/4, 29, 36, 45; 101/178, 179, 181, 219, 220, 228, 211

[56] References Cited

U.S. PATENT DOCUMENTS

| | | | |
|---|---|---|---|
| 3,323,700 | 6/1967 | Epstein et al. | 101/618 |
| 3,780,214 | 12/1973 | Bestenreiner et al. | 101/211 |
| 3,995,551 | 12/1976 | Mitter | 101/228 |
| 4,658,723 | 4/1987 | Tokuno et al. | 101/228 |
| 5,221,150 | 6/1993 | Fujioka et al. . | |
| 5,386,772 | 2/1995 | Tolle et al. | 400/618 |
| 5,423,620 | 6/1995 | Tokairin | 400/618 |

FOREIGN PATENT DOCUMENTS

| | | |
|---|---|---|
| 0317762 | 5/1989 | European Pat. Off. . |
| WO94/29113 | 12/1994 | WIPO . |

OTHER PUBLICATIONS

Patent Abstracts of Japan, vol. 17, No. 336 (M-1435) Jun. 25, 1993 & JP-A-05 042 738 (Hitachi Ltd.). Feb. 23, 1993.

*Primary Examiner*—Eugene H. Eickholt

*Attorney, Agent, or Firm*—Frishauf, Holtz, Goodman, Langer & Chick

[57] ABSTRACT

A printer comprises a convey roller for withdrawing continuous paper from a roll of the paper and conveying the paper along a predetermined convey path. The convey roller is rotated at a predetermined peripheral speed and conveys the paper with a first convey force. Four printing portions are provided sequentially along the convey path. Each of the printing portion has a printing head, and a platen roller which is brought into contact with the paper while opposing the printing head and conveys the paper with a second convey force. A sum of second convey forces of the platen rollers is set to be smaller than the first convey force. The platen rollers are rotated at peripheral speeds higher than that of the convey roller, and such that the peripheral speeds thereof are sequentially increased in an order of a platen roller adjacent to the convey roller toward a platen roller separated from the convey roller.

12 Claims, 7 Drawing Sheets

PRINTER AND METHOD OF SUPPLYING CONTINUOUS PAPER TO PRINTING PORTION

BACKGROUND OF THE INVENTION

1. Field of the Invention

The present invention relates to a printer and, more particularly, to a printer which performs printing by supplying continuous paper held by a holding portion to a printing section, and a method of supplying continuous paper to a printing portion.

2. Description of the Related Art

Generally, in a printer, the paper convey speed is determined at a predetermined value corresponding to the printing timing of a line printing head so that the dots are printed by the line printing head to have a predetermined gap between them.

When a line printing head, e.g., a line thermal head, is used, in order to convey the paper at a paper convey speed corresponding to the printing timing, the peripheral speed of each platen roller placed to oppose the line thermal head and a feed roller that supplies paper to a portion between the thermal head and the platen roller is controlled to coincide with the paper convey speed.

For example, in a color printer in which four line thermal heads are sequentially arranged along a paper convey path to perform color printing on the paper by using yellow, magenta, cyan, and black ink ribbons, respectively, the printing errors of the respective line thermal heads appear as color misregistration. Therefore, the peripheral speeds of the four platen rollers respectively placed to oppose the four line thermal heads must be controlled at a higher precision. For this purpose, the peripheral speeds of all the platen rollers, and of a feed roller are controlled at a high precision so that they coincide with the paper convey speed corresponding to the printing timings.

However, when continuous paper is used, the continuous paper is generally rolled, and the paper is withdrawn from the roll and supplied to the thermal heads. In the initial printing stage where the roll diameter is large, the roll portion of the continuous paper has a considerable weight, which causes a starting resistance at the start of the paper convey operation. Thus, a large tension acts on the paper withdrawn from the roll portion. This tension largely varies depending on the roll diameter and the like. A variation in tension acting on the paper causes a variation in printing timing, leading to a disorder in printing.

Furthermore, in the color printer, the shapes and sizes of a plurality of platen rollers have errors due to the limitation in parts precision. It is, therefore, difficult to make the peripheral speeds of all the platen rollers to completely coincide with each other. Accordingly, during conveyance of the paper by these platen rollers, the paper between the platen rollers (paper in the vicinity of a printing head) becomes loose, or an excessive tension acts on the paper to make it slip on a platen, causing disorder in conveyance. A disorder in paper conveyance causes a disorder in printing, e.g., an erroneous printing timing, leading to a printing error such as color misregistration.

SUMMARY OF THE INVENTION

The present invention has been made in view of the above circumstances, and has as its object to provide a printer using a continuous paper, in which a disorder in paper conveyance is prevented, so that a high printing quality can be maintained, and to provide a method which can supply continuous paper to a printing section at a high precision.

In order to achieve this object, according to an aspect of the present invention, there is provided a printer comprising:

convey means for conveying continuous paper along a predetermined convey path, the convey means having a convey roller which is brought into contact with the paper and conveys the paper with a first convey force, and driving means for rotating the convey roller at a predetermined peripheral speed;

a plurality of printing means, provided sequentially along the convey path, for printing desired information on the paper conveyed by the convey means, each of the printing means having a printing head capable of being brought into contact with the paper, and a platen roller which is brought into contact with the paper while opposing the printing head and conveys the paper with a second convey force, a sum of second convey forces of the plurality of platen rollers being set to be smaller than the first convey force; and platen driving means for rotating the plurality of platen rollers at peripheral speeds higher than that of the convey roller and driving the plurality of platen rollers such that the peripheral speeds thereof are sequentially increased in an order of a platen roller adjacent to the convey roller toward a platen roller separated from the convey roller.

According to the printer having the above arrangement, the first convey force of the convey roller is set to be larger than the sum of the second convey forces of the plurality of platen rollers, and the convey roller is driven at a predetermined peripheral speed, i.e., at a peripheral speed coinciding with a desired paper convey speed. Therefore, even when errors exist in the shapes and sizes of the plurality of platen rollers, the paper is fed to the respective printing means by the convey roller at the desired convey speed corresponding to the printing timings without being influenced by the convey force of the platen rollers.

Each platen roller is driven by the platen driving means to rotate at a peripheral speed equal to or higher than the peripheral speed of the convey roller, and the peripheral speeds of the plurality of platen rollers are sequentially increased from the convey roller side. As the convey force of each platen roller is smaller than that of the convey roller, each platen roller is rotated while slipping on the paper. As a result, an appropriate tension acts on the paper fed from the convey roller, and the paper is conveyed without becoming loose between adjacent platen rollers.

According to another aspect of the present invention, there is provided a printer comprising:

a holding portion for holding a roll type wound continuous paper;

convey means for withdrawing the paper from the holding portion and conveying the paper along a predetermined convey path, the convey means having a first convey roller which is in contact with the paper, first driving means for rotating the first convey roller at a predetermined speed, a second convey roller provided between the first convey roller and the holding portion to be in contact with the paper, and second driving means for rotating the second convey roller;

printing means provided along the convey path, for printing desired information on the paper conveyed by the convey means;

detecting means for detecting a stretched/loosened state of the paper between the first and second convey rollers; and control means for controlling the second driving means in accordance with a detection result of the detecting means and maintaining the paper at a loose state between the first and second convey rollers.

According to the printer having the above arrangement, the first convey roller is driven by the first driving means to rotate at a predetermined peripheral speed and to convey the paper at a desired paper convey speed corresponding to a printing timing. The second convey roller is driven by the second driving means and withdraws the paper from the roll at the holding portion and supplies the paper to the first convey roller. The stretched/loosened state of the paper between the first and second convey rollers is controlled by the control means in accordance with a detection result obtained by the detecting means, so that the paper is maintained at a loose state.

For example, when the paper between the first and second convey rollers is tightly stretched, the second convey roller is rotated by the second driving means at a peripheral speed higher than that of the first convey roller under the control of the control means. Therefore, the amount of paper conveyed to the first convey roller side by the convey means becomes larger than the amount of paper conveyed to the printing means side by the convey means, so that the paper becomes loose between the first and second convey rollers.

According to another aspect of the present invention, there is provided a method of supplying continuous paper to printing means, the method comprising steps of:

conveying continuous paper along a predetermined convey path, which extend through a plurality of printing sections, with a first convey force by a convey roller which is rotated at a predetermined peripheral speed;

applying a second convey force to the paper at each of the printing sections by a guide roller rotating at a peripheral speed higher that of the convey roller, a sum of second convey forces of the guide rollers being set to be smaller than the first convey force; and controlling the rotation of the guide rollers such that the peripheral speeds thereof are sequentially increased in an order of a guide roller adjacent to the convey roller toward a guide roller separated from the convey roller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

FIGS. 1 to 7 show a color printer according to an embodiment of the present invention, in which:

FIG. 1 is a partially cutaway side view schematically showing the entire structure of the color printer;

FIG. 2 is a side view showing a paper convey mechanism;

FIG. 3 is a plan view of the paper convey mechanism;

FIG. 4 is a schematic enlarged side view of a printing portion;

FIG. 5 is a side view of printing portions and ink ribbon magazines;

FIG. 6 is a block diagram schematically showing the driving system and the control system of the entire color printer; and FIG. 7 is a flow chart showing a paper tension control process.

DETAILED DESCRIPTION OF THE PREFERRED EMBODIMENT

An embodiment of the present invention will be described in detail with reference to the accompanying drawings.

Figure 1:
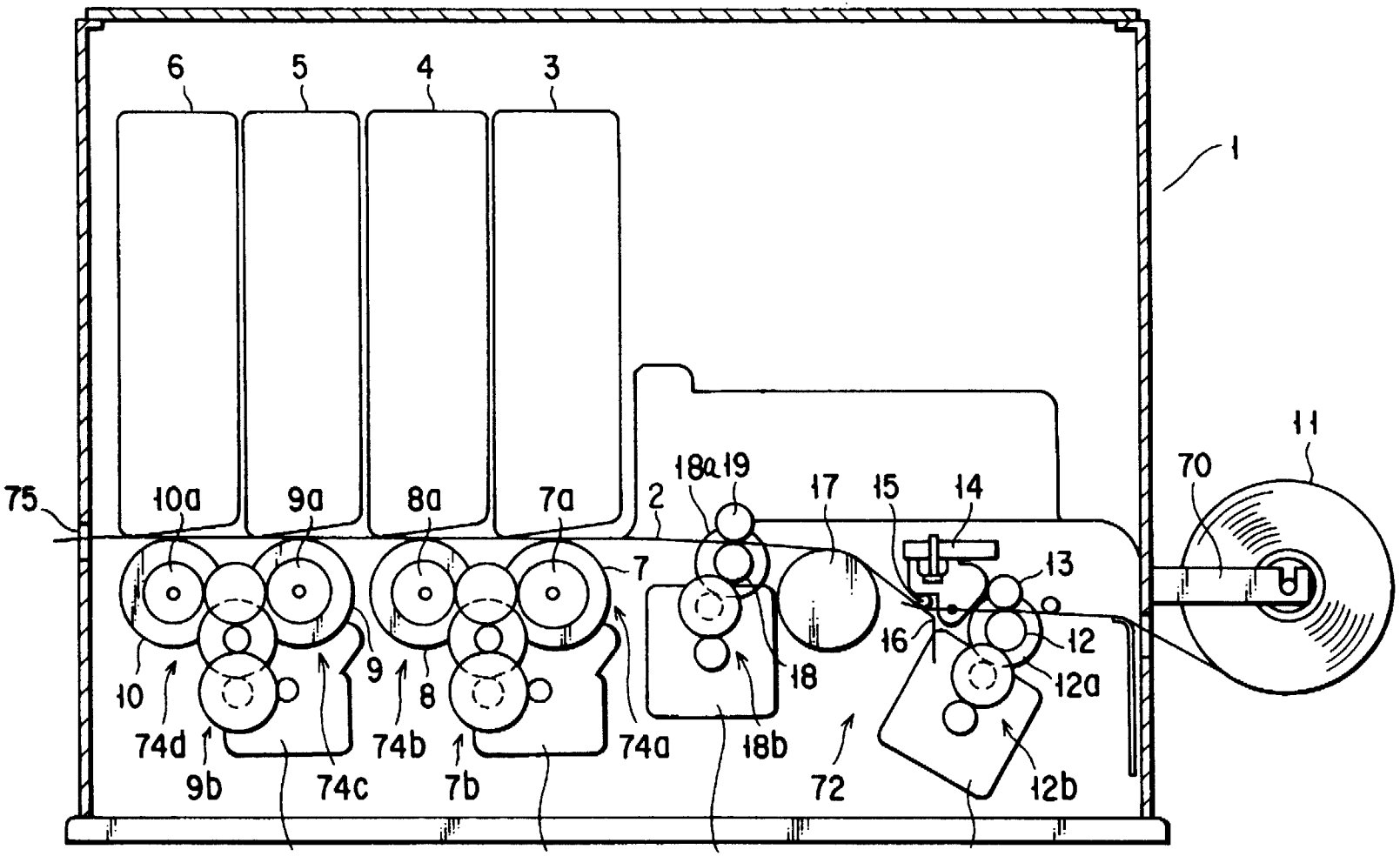

FIG. 1 shows a single path type color printer having four printing portions that are sequentially provided along a paper convey path. The color printer has a substantially rectangular box-shaped printer body 1, and support arms 70 constituting a holding portion are provided to project from one side wall of the printer body 1. A paper roll 11 obtained by rolling continuous paper is rotatably supported by the support arms 70.

In the printer body 1, a convey mechanism 72, first to fourth printing portions 74*a* to 74*d*, and first to fourth ink ribbon magazines 3 to 6 are provided. The convey mechanism 72 withdraws the paper from the paper roll 11 and conveys it along a predetermined convey path 2. The first to fourth printing portions 74*a* to 74*d* are sequentially located along the convey path 2 from the convey mechanism 72 side. The first to fourth ink ribbon magazines 3 to 6 are located to respectively oppose the first to fourth printing portions 74*a* to 74*d*. The paper withdrawn from the paper roll 11 by the convey mechanism 72 is sequentially conveyed to the first to fourth printing portions 74*a* to 74*d* along the convey path 2, and desired images are printed on the paper at the respective printing portions. Thereafter, the paper is discharged through a discharge port 75 formed in the printer body 1.

Figure 2:
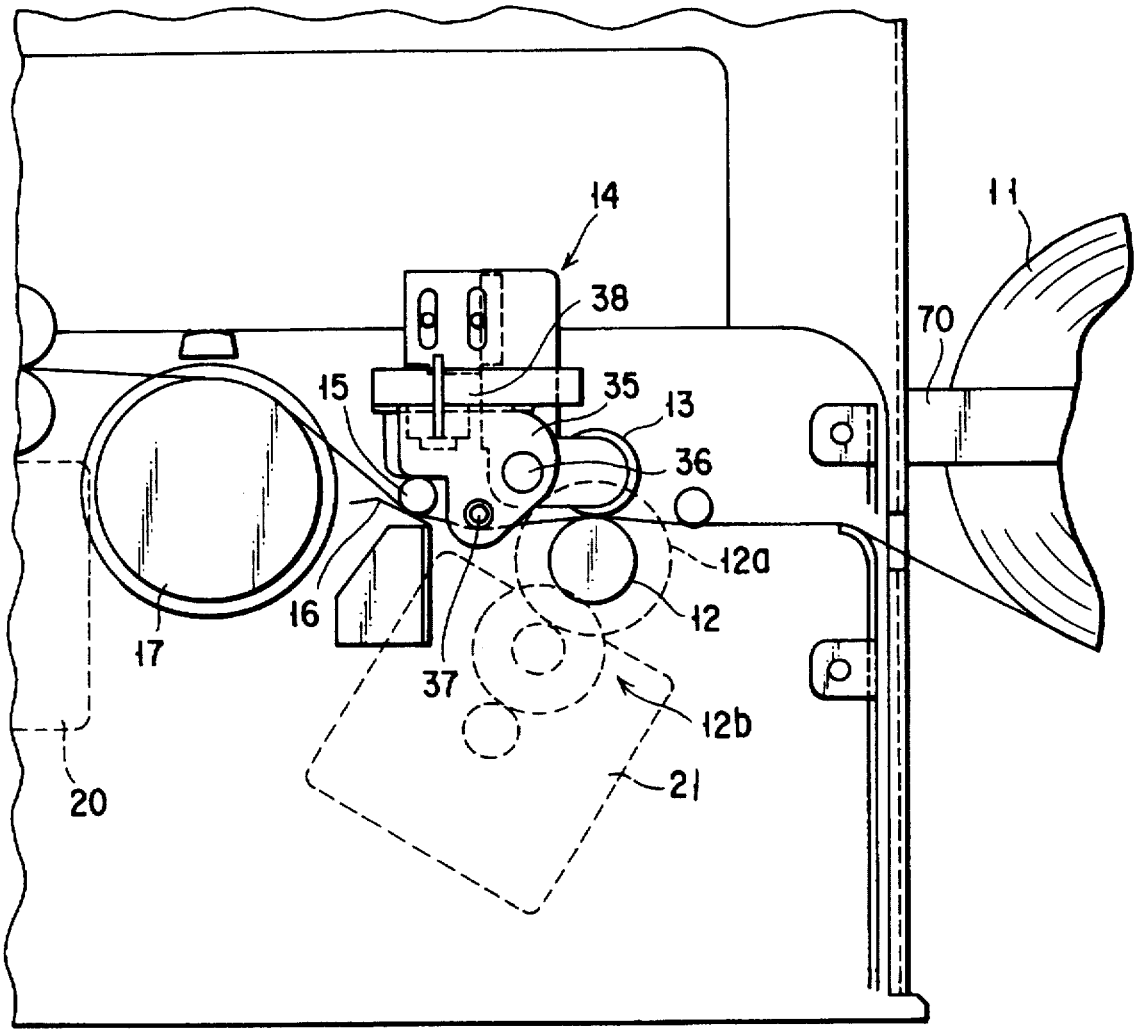
Figure 3:
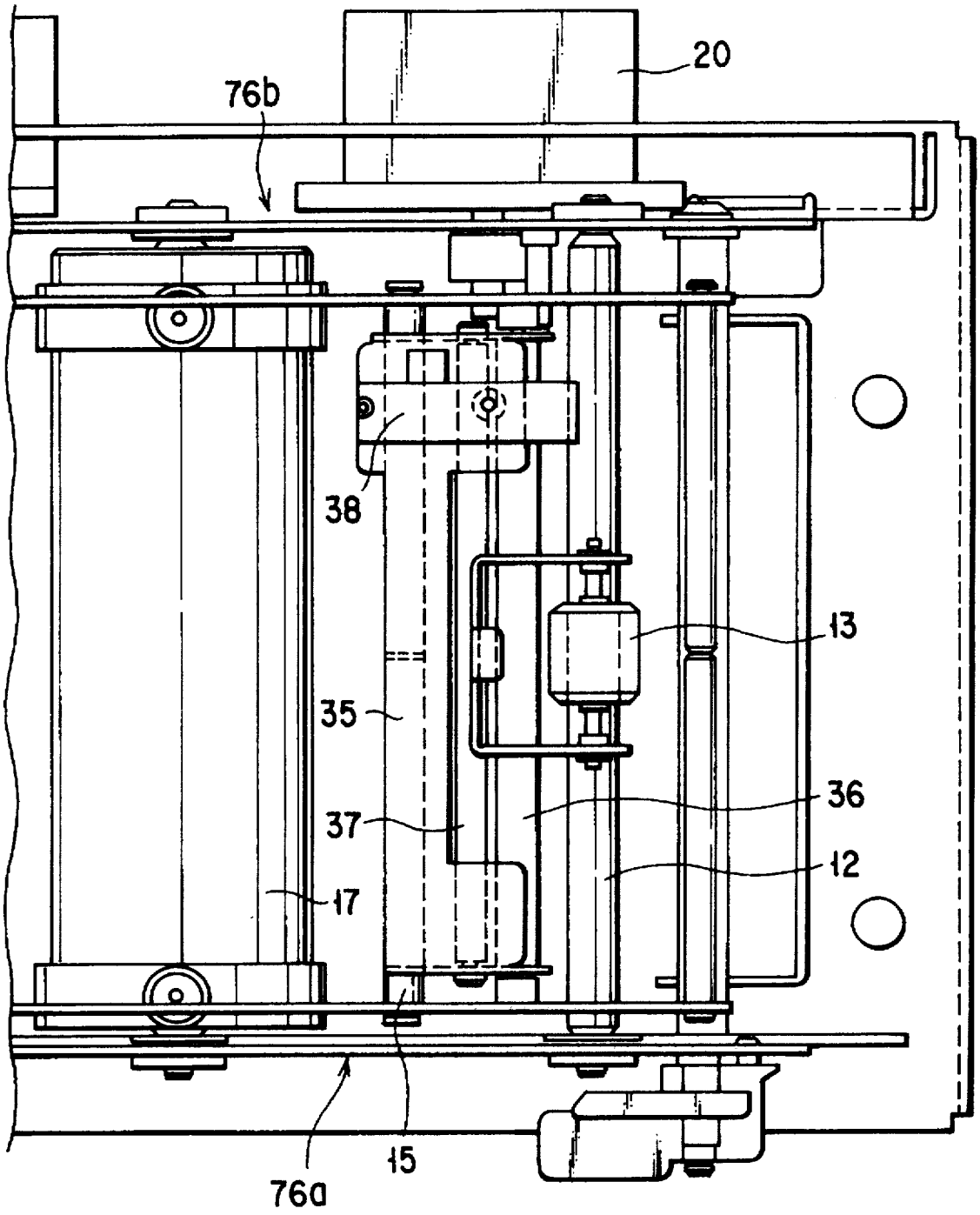

As shown in FIGS. 1 to 3, the convey mechanism 72 has a first convey roller 18, a press roller 19, a second convey roller 12, a press roller 13, guide rollers 15 and 17, and a guide plate 16. The first convey roller 18 is provided adjacent to the first printing portion 74*a*. The press roller 19 is in rolling contact with the first convey roller 18 at a predetermined pressure. The second convey roller 12 is provided on the paper roll 11 side with respect to the first convey roller 18. The press roller 13 is in rolling contact with the second convey roller 12 at a predetermined pressure. The guide rollers 15 and 17 are provided between the first and second convey rollers 18 and 12. The guide plate 16 is provided to oppose the guide roller 15. These first and second convey rollers 18 and 12, the press roller 19, and the guide rollers 15 and 17 are rotatably supported between parallel support frames 76*a* and 76*b* of the printer body 1, and arranged to extend in a direction perpendicular to the paper convey direction.

A gear 18*a* is fixed to the rotating shaft of the first convey roller 18, and is connected to the rotating shaft of a first stepping motor 20 through a gear train 18*b*. The first stepping motor 20 is mounted on the support frame 76*b* of the printer body 1 and serves as the first driving means. Thus, the first convey roller 18 is rotated by the first stepping motor 20 at a predetermined peripheral speed. Similarly, a gear 12*a* is fixed to the rotating shaft of the second convey roller 12, and is connected to the rotating shaft of a second stepping motor 21 through a gear train 12*b*. The second stepping motor 21 is mounted on the support frame 76*b* of the printer body 1 and serves as the second driving means. The second convey roller 12 is rotated by the second stepping motor 21 at a predetermined peripheral speed.

When the second convey roller 12 is rotated, the paper is conveyed while being sandwiched between the second convey roller 12 and the press roller 13, and is withdrawn from the paper roll 11. Subsequently, the paper passes between the guide roller 15 and the guide plate 16 and along the guide roller 17, and is supplied to a portion between the first convey roller 18 and the press roller 19. Furthermore, the paper is conveyed to the printing portions by the convey force of the first convey roller 18.

Note that the surface of the first convey roller 18 is made of a material, e.g., rubber, having a high friction coefficient, which is higher than that of the surface of the platen roller of each printing portion to be described later. Assuming that the paper convey force of the first convey roller 18 and the press roller 19 is a first convey force and that the paper convey force of each platen roller is a second convey force, the first convey force is set to be larger than the sum of the second convey forces of the four platen rollers. The first convey force can be adjusted to a desired value by altering the friction coefficient of the surface of the first convey roller 18 or by altering the pressure of the press roller 19 against the first convey roller 18.

As the first convey roller 18, a projection roller having a large number of projections on its circumferential surface, a spray coating roller having a sprayed surface, or the like can be used.

As shown in FIGS. 1 to 3, a tension detection unit 14 is provided between the first and second convey rollers 18 and 12, and particularly between the guide roller 15 and the second convey roller 12, to detect the stretched/loosened state of the paper between them.

The tension detection unit 14 has a support shaft 36, a pivot frame 35, a detection roller 37, and a detection switch 38. The support shaft 36 is provided between the support frames **76*a* and 76*b* of the printer body 1 and extends parallel to the second convey roller 12. The pivot frame 35 is pivotally supported by the support shaft 36. The detection roller 37, serving as a contact member, is rotatably mounted on the pivot frame 35 and extends parallel to the support shaft 36. The detection switch 38 is mounted on the pivot frame 35**.

The detection roller 37 is brought into contact with the paper from above to be lightly placed on it between the second convey roller 12 and the guide roller 15, and is vertically moved in accordance with the stretched/loosened state of the paper. More specifically, the detection roller 37 is moved downward by its own weight when the paper is loose and is moved upward by the paper when the paper is tightly stretched. In accordance with the movement of the detection roller 37, the pivot frame 35 pivots about the support shaft 36, and the detection switch 38 is turned on/off in accordance with the pivot movement of the pivot frame 35. The detection roller 37 may be urged downward by a spring or the like.

When the paper becomes tightly stretched, the detection roller 37 is pushed upward by the paper, the pivot frame 35 is pivoted clockwise in FIG. 2, and the detection switch 38 is turned on. Accordingly, the stretched/loose state of the paper can be detected by detecting the ON/OFF state of the detection switch 38.

As shown in FIG. 1, the first to fourth printing portions **74*a* to 74*d* respectively include first to fourth platen rollers 7 to 10 disposed in a row under the paper convey path 2, and head blocks provided above the paper convey path 2 to oppose the corresponding platen rollers 7 to 10. The first to fourth platen rollers 7 to 10 are rotatably supported between the support frames 76*a* and 76*b* of the printer body 1 and arranged in a direction perpendicular to the paper convey direction. These platen rollers 7 to 10 have the same diameter, and are rotated such that their outer circumferential surfaces are in contact with the paper. As described above, each platen roller has an outer circumferential surface having a friction coefficient lower than that of the outer circumferential surface of the first convey roller 18, and conveys the paper with the second convey force. The platen rollers 7 to 10** serve also as guide rollers of the present invention.

The respective head blocks are not shown in FIG. 1 as they are housed in the ink ribbon magazines 3 to 6.

Gears **7*a* and 8*a* having different gear ratios are mounted on the rotating shaft of the platen roller 7 of the first printing portion 74*a* that performs printing first and on the rotating shaft of the platen roller 8 of the second printing portion 74*b* that performs printing second, respectively. These gears 7*a* and 8*a* are connected to the rotating shaft of a third stepping motor 22, mounted on the support frame 76*b* of the printer body 1, through a gear train 7*b*. The first and second platen rollers 7 and 8 are driven by the third stepping motor 22** at different peripheral speeds.

Gears **9*a* and 10*a* having different gear ratios are mounted on the rotating shaft of the platen roller 9 of the third printing portion 74*c* that performs printing third and on the rotating shaft of the platen roller 10 of the fourth printing portion 74*d* that performs printing fourth, respectively. These gears 9*a* and 10 are connected to the rotating shaft of a fourth stepping motor 23, mounted on the support frame 76*b*, through a gear train 9*b*. The third and fourth platen rollers 9 and 10 are driven by the fourth stepping motor 23** at different peripheral speeds.

The third and fourth stepping motors 22 and 23, and the plurality of gears connected between the two stepping motors 22 and 23 and the platen rollers 7 to 10 serve as the platen driving means. The peripheral speeds of the platen rollers 7 to 10 are higher than that of the first convey roller 18 and are sequentially increased in a printing order by adjusting the rotational speeds of the respective motors and the gear ratios of the respective gears. More specifically, the peripheral speeds of the platen rollers are sequentially increased from the first platen roller 7 adjacent to the first convey roller 18 toward the fourth platen roller 10 separated from the first convey roller 18.

The head blocks of the printing portions opposing the corresponding platen rollers will be described. Since these head blocks have the same arrangement, a head block 78 of the first printing portion **74*a*** will be described as the representative, and a description of the three remaining head blocks will be omitted.

Figure 4:
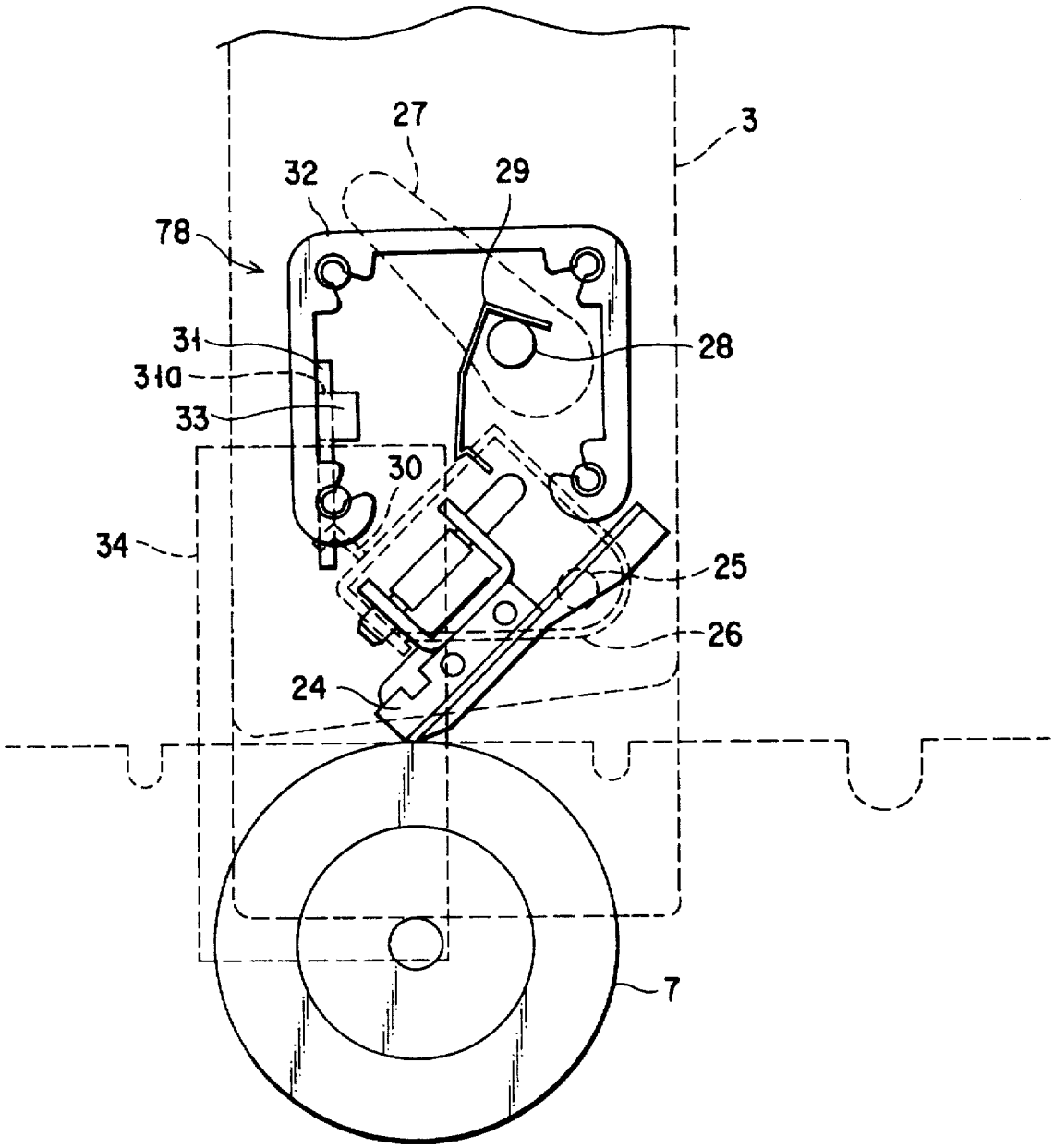
Figure 5:
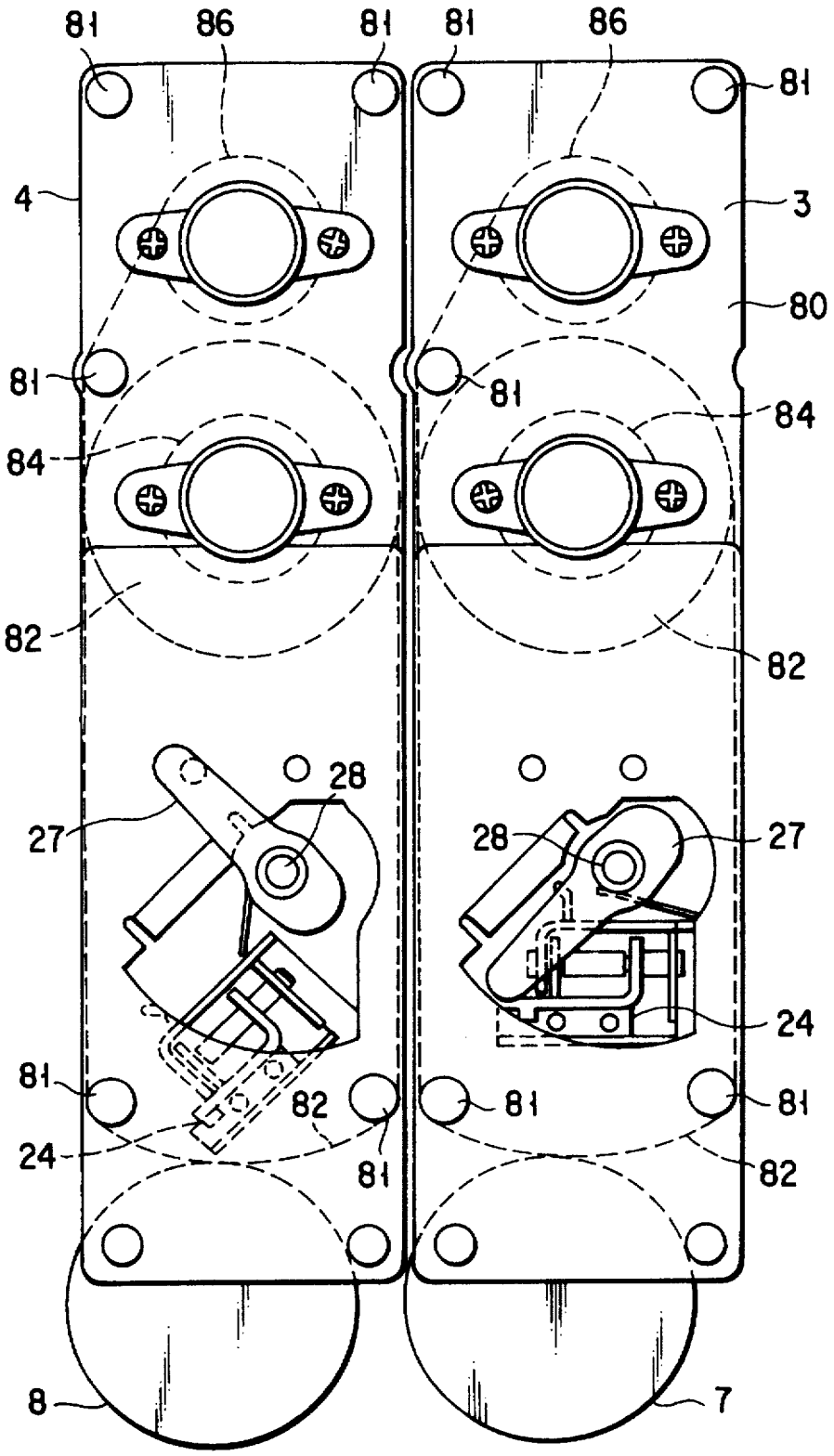

As shown in FIGS. 4 and 5, the head block 78 has a line thermal head 24 serving as a printing head, and the thermal head 24 is mounted on a pivotal head mounting plate 26 having a rotating shaft 25 and extends parallel to the platen roller 7. A head press spring 29 connected to a rotating shaft 28 of a head-up lever 27 is connected to the head mounting plate 26. When the head-up lever 27 is rotated, the head press spring 29 is rotated, and the head mounting plate 26 is pivoted about the rotating shaft 25 as the center. Thus, the thermal head 24 is moved to either a printing position shown in FIG. 4, where it is brought into contact with the outer circumferential surface of the platen roller 7, and a release position shown in FIG. 5, where it is separated from the outer circumferential surface of the platen roller 7.

A mounting pawl 30 projects from the head mounting plate 26, and is engaged in an engaging hole (not shown) of a transmission plate 31. The head block 78 has a stationary frame 32 fixed to the printer body 1, and a transmission plate shaft 33 is provided on the stationary frame 32. The transmission plate shaft 33 is engaged with a pivot hole 31*a* formed in the transmission plate 31, to pivotally fix the transmission plate 31 to the stationary frame 32.

The plunger of a self-hold solenoid 34 is connected to an end portion of the transmission plate 31 which is on an opposite side of the pivot hole 31*a* with respect to the engaging hole. When this plunger is driven in the retracting direction, the transmission plate 31 is pivoted about the transmission plate shaft 33 as the pivot center, to move the mounting pawl 30 of the head mounting plate 26 upward (in a direction to separate from the platen roller 7). Thus, the thermal head 24 is moved to the release position against the head press spring 29. When the plunger is driven in the projecting direction, the mounting pawl 30 of the head mounting plate 26 is moved downward (toward the platen roller 7), and the thermal head 24 is moved to the contact position. Even when the thermal head 24 is set at the contact position by the head-up lever 27, it can be moved to the release position as required by energizing the self-hold solenoid 34 in this manner.

As shown in FIGS. 1, 4, and 5, the first to fourth ink ribbon magazines 3 to 6 are detachably fitted to the printer body 1 and are located in series in this order above the paper convey path 2. These ink ribbon magazines 3 to 6 are mounted to cover the corresponding head blocks 78. Yellow, magenta, cyan, and black ink ribbons are set in the first to fourth ink ribbon magazines 3 to 6, respectively.

The first ink ribbon magazine 3 has a pair of parallel support plates 80 (only one is shown) separated from each other in the axial direction of the platen roller 7, and the support plates 80 are coupled to each other through a plurality of connection rods 81. A supply reel 84 on which an unused ink ribbon 82 is wound, and a take-up reel 86 for taking up a used ink ribbon are rotatably supported between the support plates 80. The supply reel 84 and the take-up reel 86 extend parallel to the platen roller 7 and are arranged in a row in the vertical direction above the platen roller 7 and the head block 78.

A feed motor and a take-up motor (neither are shown) are mounted on the support frame 76*b* of the printer body 1. When the first ink ribbon magazine 3 is mounted in the printer body 1, the supply reel 84 and the take-up reel 86 are connected to the feed motor and the take-up motor, respectively. When the feed motor and the take-up motor are driven, the ink ribbon 82 is supplied from the supply reel 84, passes between the thermal head 24 and the paper, and is taken up by the take-up reel 86.

The second to fourth ink ribbon magazines 4 to 6 have the same arrangement as that of the first ink ribbon magazine 3 except for the color of the ink ribbons 82 mounted in them, and a detailed description thereof will thus be omitted. Second to fourth feed motors and second to fourth take-up motors (neither are shown) are mounted in the printer body 1 to correspond to the second to fourth ink ribbon magazines 4 to 6.

Figure 6:
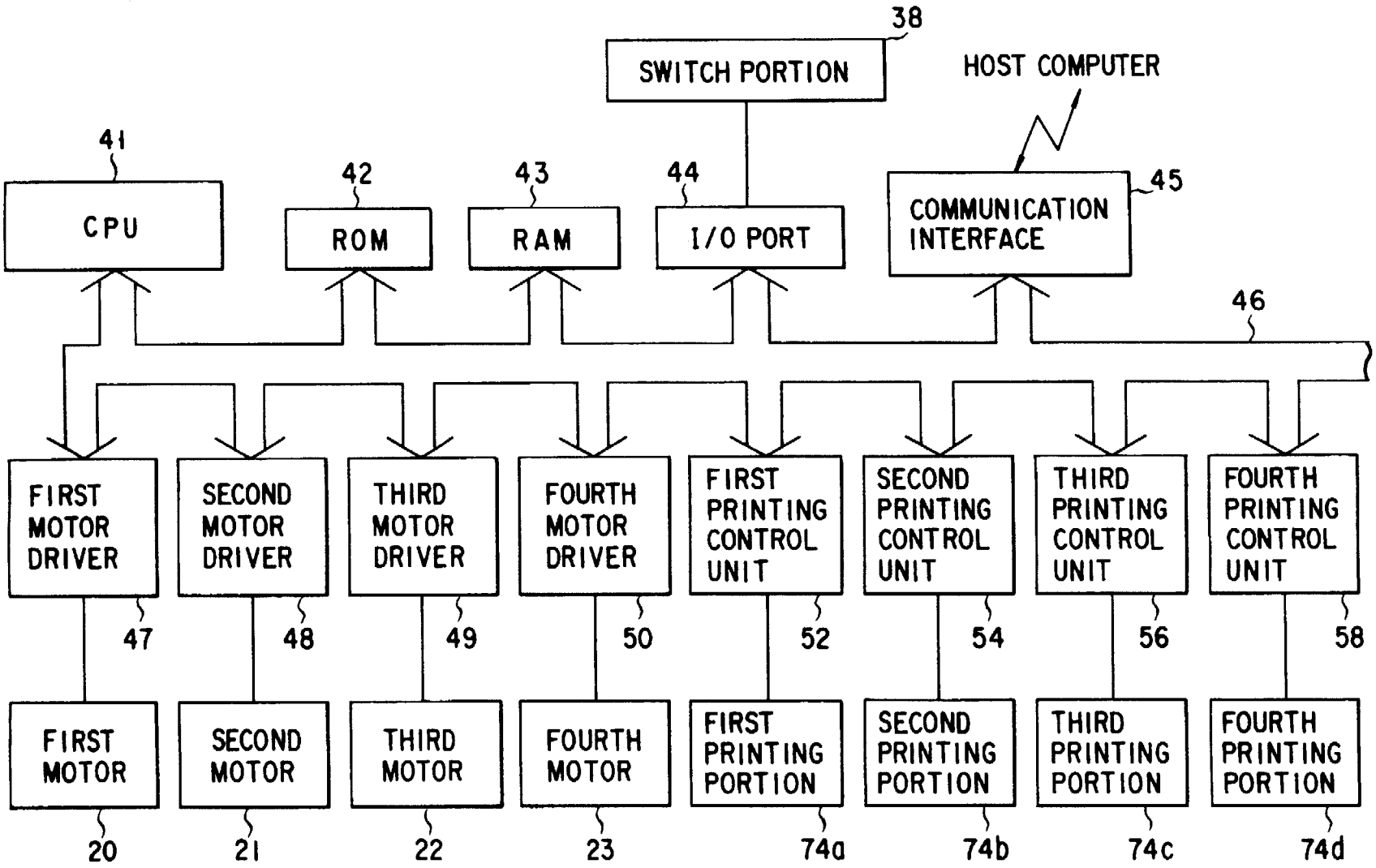

FIG. 6 shows the configuration of the driving system and control system of the color printer having the above arrangement.

A CPU 41 constituting a control section is connected to a ROM 42, a RAM 43, an I/O port 44, and a communication interface 45 through a system bus 46. The ROM 42 stores program data of the processing operation performed by the CPU 41. The RAM 43 stores the program data of the processing operation performed by the CPU 41, and executes a predetermined arithmetic operation. The I/O port 44 receives a detection signal output from the detection switch 38 of the detection unit 14. The communication interface 45 is connected to the host computer through a circuit.

The CPU 41 is also connected to first to fourth motor drivers 47 to 50 through the system bus 46. The first to fourth motor driver 47 to 50 drives the first to fourth stepping motors 20 to 23, respectively.

The CPU 41 is also connected to first to fourth printing control units 52, 45, 56, and 58 through the system bus 46. The first printing control unit 52 controls the first printing portion 74*a* including the feed motor for driving the ink ribbon 82 of the first ink ribbon magazine 3, the take-up motor, the thermal head 24 for performing printing first, and the like. The second printing control unit 54 controls the second printing portion 74*b* including the feed motor for driving the ink ribbon 82 of the second ink ribbon magazine 4, the take-up motor, the thermal head 24 for performing printing second, and the like. The third printing control unit 56 controls the third printing portion 74*c* including the feed motor for driving the ink ribbon 82 of the third ink ribbon magazine 5, the take-up motor, the thermal head 24 for performing printing third, and the like. The fourth printing control unit 58 controls the fourth printing portion 74*d* including the feed motor for driving the ink ribbon 82 of the fourth ink ribbon magazine 6, the take-up motor, the thermal head 24 for performing printing fourth, and the like.

According to the color printer having the above arrangement, during operation, when the first to fourth stepping motors 20 to 23 are driven at the predetermined rotational speeds under the control of the CPU 41, the continuous paper is withdrawn from the paper roll 11 by the second convey roller 12 and the press roller 13, and is conveyed to a portion between the first convey roller 18 and the press roller 19 through the guide rollers 15 and 17 in this order. Subsequently, the paper is supplied to the first to fourth printing portions 74*a* to 74*d* in this order, and is fed to the discharge port 75 by the first convey roller 18 and the press roller 19.

During this operation, the first convey roller 18 is driven at a peripheral speed equal to a predetermined paper convey speed corresponding to the printing timing, and the paper is conveyed by the first convey roller 18 at the predetermined paper convey speed. Since the first to fourth platen rollers 7 to 10 are driven by the third and fourth stepping motors 22 and 23 at peripheral speeds higher than that of the first convey roller 18, they are rotated while slipping on the paper. Furthermore, since the first to fourth platen rollers 7 to 10 are controlled such that their peripheral speeds are sequentially increased in this order, an appropriate tension generated by slippage of the platen rollers acts on the paper, so that the paper is conveyed without becoming loose during traveling from the first convey roller 18 to the fourth platen roller 10.

The paper travels through the respecting printing portions while being sandwiched between the platen rollers and the ink ribbons. After the thermal head 24 is moved to the contact position and the ink ribbon 82 is caused to travel by the feed motor and the take-up motor, when the thermal head 24 is operated by the corresponding printing control unit, an image is printed on the paper in the corresponding color at each printing portion.

During the printing operation described above, the stretched/loosened state of the paper between the first and second convey rollers 18 and 12 is constantly detected by the detection unit 14 in accordance with the following processing, so that the paper is maintained at a predetermined stretched/loosened state, i.e., loose state.

Figure 7:
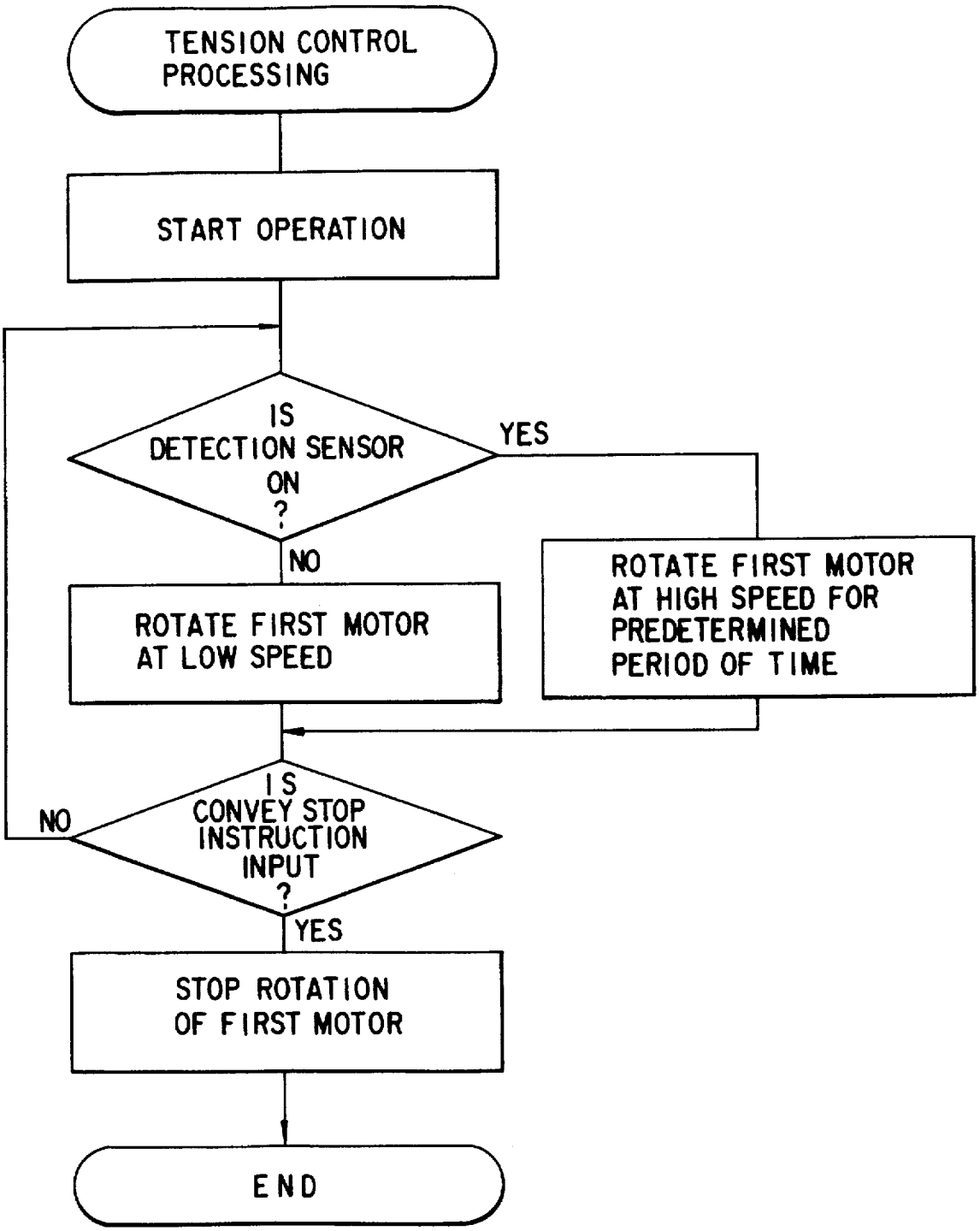

More specifically, during the printing operation, the CPU 41 detects and controls the looseness and tightness of the paper as shown in FIG. 7. When the operation of the color printer is started, a detection signal output from the detection switch 38 of the detection unit 14 is input through the I/O port 44, and whether the detection switch 38 is ON or OFF is checked from the detection signal.

When the detection switch 38 is ON, i.e., when the paper is tightly stretched and the detection roller 37 is pushed up, the second stepping motor 21 is driven through the second motor driver 48 to drive the second convey roller 12 at a high speed, i.e., at a higher peripheral speed than that of the first convey roller 18 for a predetermined period of time. Accordingly, the amount of paper fed with the second convey roller 12 and the press roller 13 by the second stepping motor 21 becomes larger than the amount of paper fed with the first convey roller 18 and the press roller 19 by the first stepping motor 20, so that continuous paper is loosened between the second convey roller 12 and the guide roller 15.

As the paper becomes loose, the detection roller 37 is moved downward, and the detection switch 38 is turned off. When the detection switch 38 is turned off, the second stepping motor 21 is restored to a low speed, i.e., a normal speed, through the second motor driver 48, and the second convey roller 12 is driven at such a peripheral speed that the convey speed of the continuous paper fed by the first convey roller 18 rotated by the first stepping motor 20 and that of the continuous paper fed by the second convey roller 12 coincide with each other. Thus, loosening of the continuous paper between the second convey roller 12 and the guide roller 15 is stopped, and this loose state is maintained.

Then, whether a convey stop instruction is input or not is checked. If a convey stop instruction is not input, the initial processing operation of the detection and control of the looseness and tightness of the paper described above is repeated. If a convey stop instruction is input, the respective motors are stopped, and the detection control processing operation is ended.

In the color printer according to this embodiment having the above arrangement, the peripheral speeds of the first to fourth platen rollers 7 to 10 are sequentially increased in a printing order so as to satisfy an inequality: (first convey roller 18)<(platen roller 7)<(platen roller 8)<(platen roller 9)<(platen roller 10). In addition, the friction coefficient of the surface of the first convey roller 18 is larger than that of each of the surfaces of the platen rollers 7 to 10, and the first convey force of the first convey roller 18 is larger than the sum of the second convey forces of the respective platen rollers. Thus, although the continuous paper is pulled by the platen rollers 7 to 10, the pulling force is smaller than the convey force of the first convey roller 18 and the press roller 19, so that the paper is conveyed to coincide with the peripheral speed of the first convey roller 18. Simultaneously, the paper is conveyed without becoming loose while it slips on the first to fourth platen rollers 7 to 10 in accordance with their peripheral speeds. Therefore, the looseness of the continuous paper at the respective printing positions, i.e., a disorder in conveyance is prevented, thereby maintaining a high printing quality.

The stretched/loosened state of the paper between the second convey roller 12 and the guide roller 15 is constantly detected by the detection unit 14. When the detection unit 14 detects that the paper is not loose and becomes tight, the second stepping motor 21 is rotated at a high speed for a predetermined period of time, thereby increasing the peripheral speed of the second convey roller 12. Therefore, the paper can always be maintained at a predetermined loose state. As a result, the rotational resistance of the paper roll 11 does not directly act on the paper between the first convey roller 18 and the second convey roller 12, and the first convey roller 18 can convey the paper at a predetermined speed without being influenced by a variation in tension caused by the paper roll 11.

From the foregoing, according to the present invention, there is provided a printer using a continuous paper, in which a back tension exceeding a necessary value does not act on the paper fed to the printing head. Even if the printer has a plurality of printing heads, the looseness of the paper at printing heads, i.e., a disorder in paper conveyance, can be prevented, thereby maintaining a high printing quality.

The present invention is not limited to the embodiment described above, and various changes and modifications may be made within the spirit and scope of the invention. For example, in the above embodiment, the stretched/loosened state of the paper is maintained at a predetermined loose state by altering the peripheral speed of the second convey roller 12. However, the stretched/loosened state of the paper may be adjusted by altering the pressure of the press roller 13 against the second convey roller 12, in place of the peripheral speed of the second convey roller 12.

Further, the present invention may be applied to an image forming apparatus for forming image on a continuous paper based on an electrophotographic process.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A printer comprising:

convey means for conveying continuous paper along a predetermined convey path, said convey means having a convey roller which is brought into contact with the paper and conveys the paper with a first convey force, and driving means for rotating said convey roller at a predetermined peripheral speed;

a plurality of printing means provided sequentially along said convey path, for printing desired information on the paper conveyed by said convey means, each of said printing means having a printing head capable of being brought into contact with the paper, and a platen roller which is brought into contact with the paper while opposing said printing head and conveys the paper with a second convey force, a sum of second convey forces of said plurality of platen rollers being set to be smaller than the first convey force; and platen driving means for rotating said plurality of platen rollers at peripheral speeds higher than that of said convey roller and driving said plurality of platen rollers such that the peripheral speeds thereof are sequentially increased in an order of a platen roller adjacent to said convey roller toward a platen roller separated from said convey roller.

2. A printer according to claim 1, wherein said platen rollers include first to fourth platen rollers that are provided parallel to each other, and said platen driving means comprises a first gear coupled to said first platen roller, a second gear coupled to said second platen roller and having a different gear ratio from that of said first gear, a first motor for driving said first and second gears through a first gear train, a third gear coupled to said third platen roller, a fourth gear coupled to said fourth platen roller and having a different gear ratio from that of said third gear, and a second motor for driving said third and fourth gears through a second gear train.

3. A printer according to claim 1, wherein said convey roller comprises a circumferential surface having a predetermined friction coefficient, and each of said platen rollers comprises a circumferential surface having a friction coefficient smaller than the predetermined friction coefficient.

4. A printer according to claim 1, wherein each of said printing means comprises an ink ribbon and ribbon driving means for driving said ink ribbon to travel between said printing head and said platen roller.

5. A printer according to claim 1, which further comprises a holding portion for holding a roll type wound continuous paper, and said convey means has means for withdrawing the paper from said holding portion.

6. A printer comprising:

convey means for conveying the paper along a predetermined convey path, said convey means having a convey roller which is brought into contact with the paper and conveys the paper with a first convey force, and driving means for rotating said convey roller at a predetermined peripheral speed;

a plurality of printing means provided sequentially along said convey path, for printing desired information on the paper conveyed by said convey means; and guide means for guiding the paper traveling through the printing means, the guiding means including a guide roller which is brought into contact with the paper and conveys the paper with a second convey force smaller than the first convey force, and means for rotating said guide roller at a peripheral speed higher than that of said convey roller.

7. A printer according to claim 6, wherein said guiding means includes a plurality of guide rollers which are arranged close to the printing means, respectively, and said rotating means includes means for driving said plurality of guide rollers such that the peripheral speeds thereof are sequentially increased in an order of a guide roller adjacent to said convey roller toward a guide roller separated from said convey roller.

8. A printer comprising:

a holding portion for holding a roll type wound continuous paper;

convey means for withdrawing the paper from said holding portion and conveying the paper along a predetermined convey path, said convey means having a first convey roller which is in contact with the paper, first driving means for rotating said first convey roller at a predetermined peripheral speed, a second roller provided between said first convey roller and said holding portion to be in contact with the paper, and second driving means for rotating said second convey roller;

printing means, provided along said convey path, for printing desired information on the paper conveyed by said convey means;

detecting means for detecting a stretched/loosened state of the paper between said first and second convey rollers; and control means for controlling said second driving means in accordance with a detection result of said detecting means and maintaining the paper at a loose state between said first and second convey rollers.

9. A printer according to claim 8, wherein said control means comprises altering means for altering a rotational speed of said second convey roller in accordance with the stretched/loosened state of the paper detected by said detecting means.

10. A printer according to claim 8, wherein said control means comprises operating means for operating said second driving means such that said second convey roller is rotated at a higher peripheral speed than that of said first convey roller for a predetermined period of time when the paper is tighter than a predetermined stretched/loosened state, and for operating said second driving means such that said second convey roller is rotated at the same peripheral speed as that of said first convey roller when the paper is at the predetermined stretched/loosened state.

11. A printer according to claim 10, wherein said detecting means comprises a contact member which is in contact with the paper between said first and second convey rollers, support means for supporting said contact member to be movable in accordance with the stretched/loosened state of the paper, and a sensor for detecting movement of said contact member, and said operating means comprises means for altering a rotational speed of said second convey roller driven by said second driving means in accordance with a detection result of said sensor.

12. A method of supplying continuous paper to printing means, said method comprising steps of:

conveying continuous paper along a predetermined convey path, which extend through a plurality of printing sections, with a first convey force by a convey roller which is rotated at a predetermined peripheral speed;

applying a second convey force to the paper at each of the printing sections by a guide roller rotating at a peripheral speed higher that of the convey roller, a sum of second convey forces of the guide rollers being set to be smaller than the first convey force; and controlling the rotation of the guide rollers such that the peripheral speeds thereof are sequentially increased in an order of a guide roller adjacent to the convey roller toward a guide roller separated from the convey roller.

* * * * *